US009834967B2

(12) United States Patent
Johnson

(10) Patent No.: US 9,834,967 B2
(45) Date of Patent: Dec. 5, 2017

(54) HINGE CONSTRUCTIONS

(71) Applicant: Electrolux Home Products, Inc., Charlotte, NC (US)

(72) Inventor: Glenn L. Johnson, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/969,018

(22) Filed: Dec. 15, 2015

(65) Prior Publication Data

US 2017/0167173 A1 Jun. 15, 2017

(51) Int. Cl.

| | |
|---|---|
| ***E05D 11/06*** | (2006.01) |
| ***E05D 11/00*** | (2006.01) |
| ***E05D 7/081*** | (2006.01) |
| ***E05D 5/12*** | (2006.01) |
| ***E05D 3/02*** | (2006.01) |
| ***E05D 5/06*** | (2006.01) |
| *E05D 5/10* | (2006.01) |

(52) U.S. Cl.

CPC ..... *E05D 11/06* (2013.01); *E05D 3/02* (2013.01); *E05D 5/06* (2013.01); *E05D 5/128* (2013.01); *E05D 7/081* (2013.01); *E05D 11/0081* (2013.01); *E05D 2005/106* (2013.01); *E05Y 2900/31* (2013.01)

(58) Field of Classification Search

CPC ..... E05D 2005/102; E05D 2005/106; E05D 2011/1035; E05D 7/02; E05D 11/06; F25D 2323/022

See application file for complete search history.

(56) References Cited

U.S. PATENT DOCUMENTS 3,975,794 A * 8/1976 Kaiser ..... E05F 1/063 16/303
4,070,728 A * 1/1978 Herman ..... E05D 7/0415 16/243
4,543,800 A 10/1985 Mawby et al.
5,265,954 A 11/1993 Keil
5,369,842 A * 12/1994 Beatty ..... E05F 1/063 16/317
5,666,764 A 9/1997 Beatty et al.
5,787,724 A 8/1998 Pohl et al.
5,788,351 A * 8/1998 Prunty ..... A47L 15/4261 16/235
7,490,384 B2 * 2/2009 Lee ..... E05D 5/121 16/235
7,634,837 B2 12/2009 Schluter et al.
(Continued)

*Primary Examiner* — Jeffrey O Brien
(74) *Attorney, Agent, or Firm* — Pearne & Gordon LLP

(57) ABSTRACT

A hinge construction includes a hinge bracket that includes a hinge pin supporting plate and at least one opening extending through the hinge pin supporting plate. Also included in the hinge construction is a hinge pin that is held at the at least one opening. The hinge pin includes a hinge pin outer surface, a hinge pin bore extending through the entire length of the hinge pin and a hinge pin slot extending along the entire length of the hinge pin from the hinge pin outer surface to within the hinge pin bore. The at least one opening can be tapered, and the hinge pin outer surface can include a hinge pin outer surface first portion that also is tapered so as to be congruent with the at least one tapered opening. The hinge construction allows elements such as electrical wiring to be routed through the hinge construction.

18 Claims, 4 Drawing Sheets

(56) References Cited

U.S. PATENT DOCUMENTS

| | | | | |
|---|---|---|---|---|
| 8,235,480 | B2 | 8/2012 | Kang | |
| 8,245,352 | B2 | 8/2012 | Park | |
| 8,506,026 | B2 * | 8/2013 | Kim | F25D 23/028 312/405 |
| 8,690,273 | B2 | 4/2014 | Dolinsek et al. | |
| 8,944,540 | B2 * | 2/2015 | Kim | E05F 1/00 312/405 |
| 9,448,004 | B2 * | 9/2016 | Kim | F25D 23/028 |
| 2004/0025295 | A1 | 2/2004 | Becker | |
| 2005/0248724 | A1 | 11/2005 | Jones | |
| 2006/0064846 | A1 * | 3/2006 | Espindola | E05D 11/0081 16/223 |
| 2006/0168760 | A1 * | 8/2006 | Espindola | E05D 7/02 16/374 |
| 2009/0110338 | A1 | 4/2009 | Blase | |
| 2010/0231110 | A1 * | 9/2010 | Choi | E05D 5/02 312/405 |
| 2013/0076222 | A1 * | 3/2013 | Lee | F25D 23/028 312/405 |
| 2013/0154464 | A1 * | 6/2013 | Fiori | E05D 7/0423 312/405 |
| 2013/0249371 | A1 | 9/2013 | Lively | |
| 2013/0249372 | A1 | 9/2013 | Lively | |
| 2013/0249373 | A1 | 9/2013 | Lively | |
| 2014/0132141 | A1 * | 5/2014 | Sun | E05D 7/0027 312/404 |
| 2014/0167591 | A1 | 6/2014 | Dolinsek | |
| 2014/0232250 | A1 * | 8/2014 | Kim | F25D 23/028 312/292 |
| 2015/0059126 | A1 * | 3/2015 | Dubina | E05D 7/00 16/319 |

* cited by examiner

HINGE CONSTRUCTIONS

FIELD OF THE INVENTION

The present invention relates generally to hinge constructions and, more particularly, to hinge constructions that allow for the passage of elements through the hinge constructions.

BACKGROUND OF THE INVENTION

Structures of various types can be provided with doors that are mounted on hinges. The presence of the doors can complicate a requirement to uninterruptedly extend between locations at the structures elements that are applied at the structures. For example, electrical appliances can include electrical wiring that is routed through the appliances to various components of the appliances that require electric power for their operation. The appliances can include doors, such as refrigerator doors in the case of household refrigerators for example, that are mounted at the appliances by means of hinges whereby access can be had to the interiors of the appliances. The presence of the doors at the appliances can complicate and interfere with the uninterrupted and efficient routing of the electrical wiring applied at the appliances.

BRIEF SUMMARY OF THE INVENTION

The following presents a simplified summary of the invention in order to provide a basic understanding of some aspects of the invention. The summary does not represent an extensive overview of the invention, nor is the summary intended to identify key or critical elements of the invention or delineate the scope of the invention. The sole purpose of the summary is to present certain concepts of the invention in a simplified form as a prelude to the description of the invention that is presented hereinafter.

The present invention provides hinge constructions that facilitate the continuous routing and passage of elements through the hinge constructions between locations at a structure at which the hinge constructions are employed.

According to one aspect, a hinge construction can include a hinge bracket and a hinge pin. The hinge bracket can include a hinge pin supporting plate and at least one opening extending through the hinge pin supporting plate, the at least one opening being entirely circumscribed by the hinge pin supporting plate. The hinge pin can be held within the at least one opening and include a hinge pin outer surface. A hinge pin bore can extend through the entire length of the hinge pin, and a hinge pin slot can extend along the entire length of the hinge pin from the hinge pin outer surface to within the hinge pin bore According to another aspect, the at least one opening can comprise at least one tapered opening extending through the hinge pin supporting plate. The hinge pin outer surface can include a hinge pin outer surface first portion and a hinge pin outer surface second portion. The hinge pin outer surface first portion can be tapered in a direction along the length of the hinge pin so as to be congruent with the at least one tapered opening extending through the hinge pin supporting plate. The hinge pin can be held within the at least one tapered opening at the hinge pin outer surface first portion. The hinge pin also can include a hinge pin bore that extends through the entire length of the hinge pin and a hinge pin slot that extends along the entire length of the hinge pin from the hinge pin outer surface to within the hinge pin bore.

According to a further aspect, the at least one tapered opening extending through the hinge pin supporting plate can comprise two tapered openings extending through the hinge pin supporting plate, and the hinge pin outer surface first portion can be selectively held within one of the two tapered openings.

According to an additional aspect, the hinge pin outer surface second portion can have a cylindrical configuration and merge with the hinge pin outer surface first portion.

According to yet another aspect, the tapered openings in the hinge pin supporting plate can be entirely circumscribed by the hinge pin supporting plate.

According to yet an additional aspect, there can be included in addition to the foregoing describe hinge construction a complementary hinge construction. The complementary hinge construction can include a hinge bracket that is configured to be secured to the bottom of a door and can include a door stop. The door stop can be configured to engage an upturned portion of the hinge pin supporting plate and limit the extent to which the door to which the hinge bracket is configured to be secured can be opened.

According to yet a further aspect, the hinge constructions can be applied at the doors of refrigeration appliances, and, in particular applications of that aspect, the hinge constructions can be employed for the purpose of facilitating the continuous routing of electrical wiring between locations at household refrigerators.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
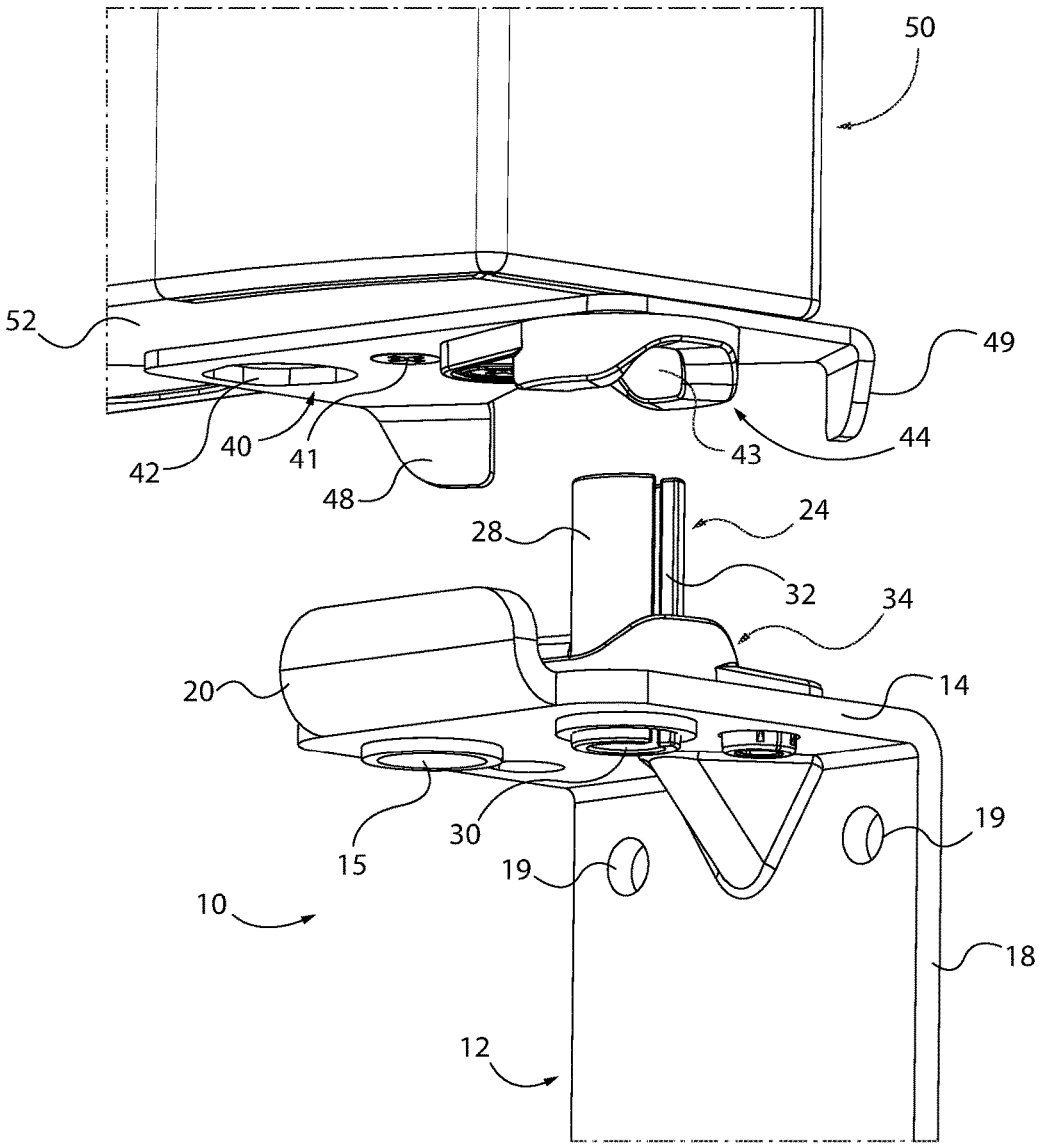
FIG. 1 is an exploded perspective view of a first example of a hinge construction in accordance with the present invention applied at the door of a refrigeration appliance.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

The hinge construction of the present invention can have widespread application in essentially all instances in which a hinge is required. In particular, the hinge construction of the present invention can be usefully applied in instances in which it is convenient or necessary to route an element such as electrical wiring for example through the hinge. An example of the application to the door of a refrigeration appliance of one embodiment of the hinge construction of the present invention is illustrated in the drawings herein and will now be described.

Figure 2:
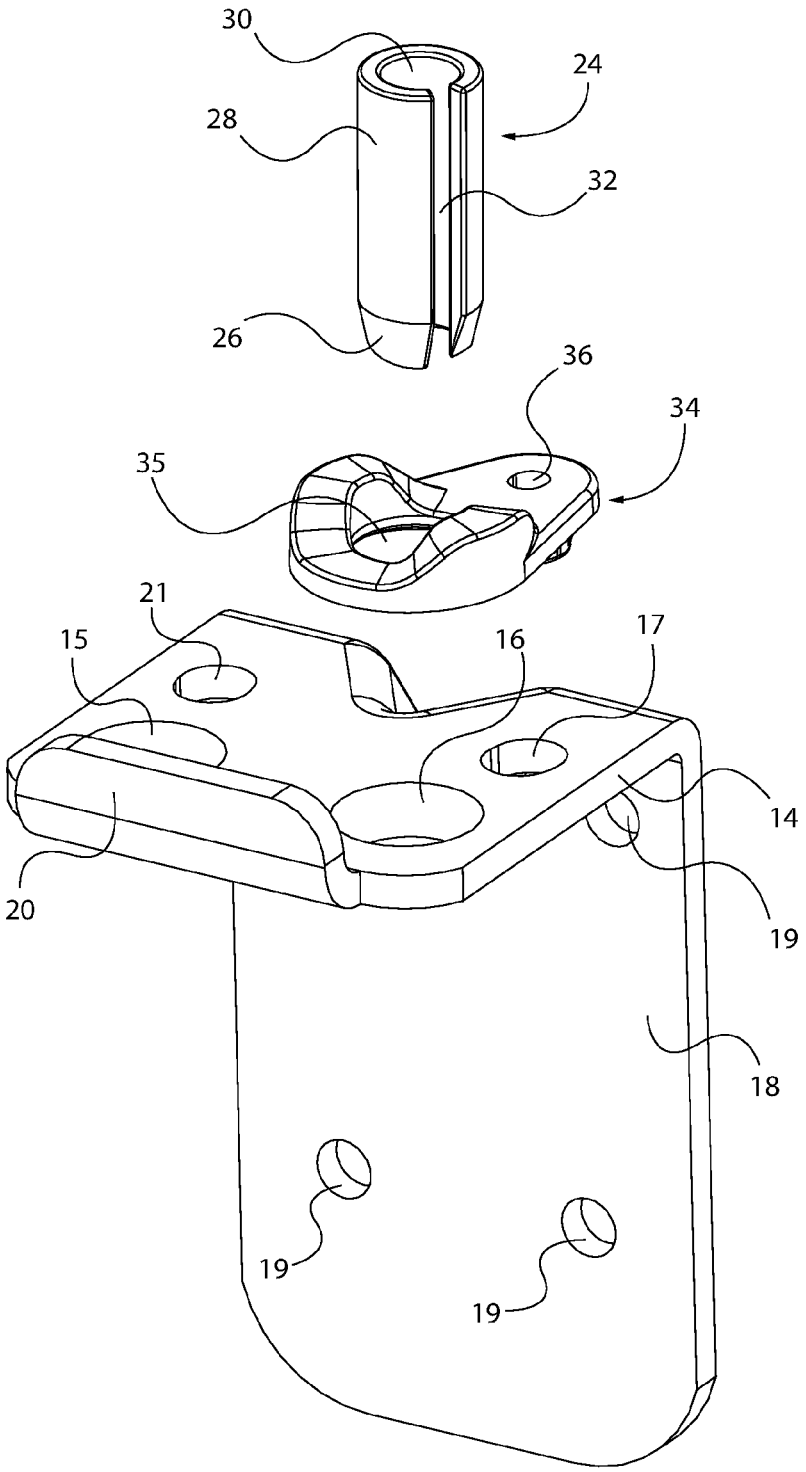
FIG. 2 is an exploded perspective view of a first selected portion of the structure of FIG. 1.

In FIGS. 1 and 2, an example of a hinge construction, indicated generally at 10, is shown as applied at the door, indicated generally at 50, of a refrigeration appliance. In that example of the invention, the hinge construction 10 is shown to include a hinge bracket, indicated generally at 12, that includes a hinge pin supporting plate 14 and at least one tapered opening extending through the hinge pin supporting plate 14. In the example illustrated in the drawings, and best seen in FIG. 2, the at least one tapered opening extending through the hinge pin supporting plate 14 comprises two tapered openings comprising left-hand tapered opening 15 and right-hand tapered opening 16.

The hinge bracket 12 also includes a mounting plate 18 that is integral with the hinge pin supporting plate 14, the hinge pin supporting plate 14 extending outwardly from the mounting plate 18 at a right angle. The mounting plate 18 provides a means by which the hinge bracket 12 can be mounted to a supporting structure. For example, the mounting plate 18 can be secured at the base of the refrigeration appliance, not shown in FIGS. 1 and 2 but shown in FIG. 3, below the door 50 using suitable fasteners such as screws for example that extend through the openings 19 in the mounting plate 18 and are secured to the base of the refrigeration appliance. The hinge pin supporting plate 14 includes a supporting plate upturned portion 20 that is located at the front of the hinge pin supporting plate 14 away from the junction of the mounting plate 18 and the hinge pin supporting plate 14 and whose function is described below.

Also included in the hinge construction is a hinge pin, indicated generally at 24, as seen in FIGS. 1 and 2. The hinge pin includes a hinge pin outer surface, including a hinge pin outer surface first portion 26 and a hinge pin outer surface second portion 28 best seen in FIG. 2. The hinge pin outer surface first portion 26 is tapered along a length of the hinge pin 24 so as to be congruent with the left-hand tapered opening 15 and the right-hand tapered opening 16, and the hinge pin outer surface second portion 28 has a cylindrical configuration that merges with the hinge pin outer surface first portion 26. The congruity of each tapered opening and the hinge pin outer surface first portion 26 allows for the hinge pin outer surface first portion 26 to be securely held within whichever tapered opening is employed. As will be understood by those having ordinary skill in the art, and as will become more apparent from the description that follows, when the hinge construction 10 is located at the right-hand side of the door 50, as shown in the drawings, the right-hand tapered opening 16 is selectively employed, and when the hinge construction 10 is located at the left-hand side of the door 50, not shown, the left-hand tapered opening 15 is selectively employed. The taper provided at each tapered opening in the hinge pin supporting plate 14 need not extend through the entire thickness of the hinge pin supporting plate 14 and need only extend that distance through the thickness that allows for the hinge pin 24 to be satisfactorily held in place at the tapered opening.

The hinge pin 24 also includes a hinge pin bore 30 that extends through the entire length of the hinge pin 24 and a hinge pin slot 32 that extends longitudinally along the entire length of the hinge pin 24 from the hinge pin outer surface, i.e., from the hinge pin outer surface first portion 26 and the hinge pin outer surface second portion 28, to within the hinge pin bore 30.

Figure 3:
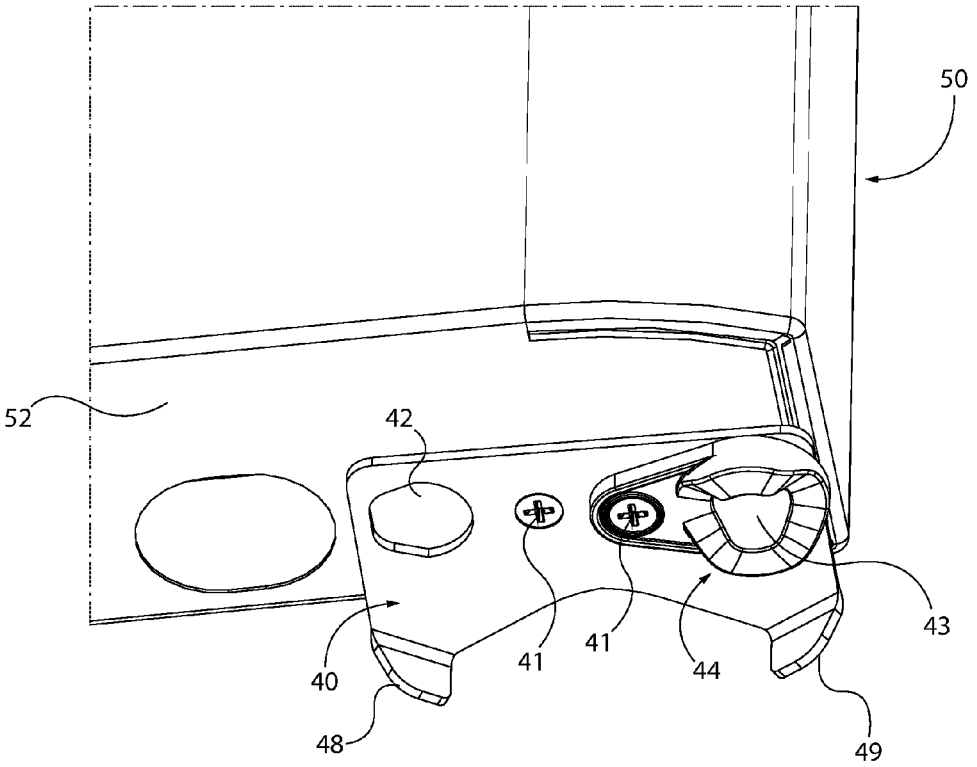
FIG. 3 is a perspective view of a second selected portion of the structure of FIG. 1.

In the example of the hinge construction described above, an example of a complementary hinge construction is provided at the bottom 52 of the door 50. That example comprises a door-mounted hinge bracket, indicated generally at 40, that can be secured to the bottom 52 of the door 50 by a suitable fastener such as a screw 41 as best shown in FIGS. 1 and 3. The door-mounted hinge bracket 40 includes at least one hinge pin opening that extends through the door-mounted hinge bracket 40. In the example illustrated in the drawings, the at least one hinge pin opening comprises two hinge pin openings comprising left-hand hinge pin opening 42 and right-hand hinge pin opening 43. Each hinge pin opening is located in line with a corresponding opening, not shown, in the bottom 52 of the door 50, which opening can comprise a socket into which the hinge pin outer surface second portion 28 extends and within which the hinge pin is rotatably held, in a manner that is familiar to those having ordinary skill in the art, when the door 50 is mounted onto the hinge construction 10. When the hinge construction 10 is selectively located at the right-hand side of the door 50, as shown in the drawings, the hinge pin 24 will extend through the right-hand hinge pin opening 43 and the opening at the bottom 52 of the door 50 that is in line with the right-hand hinge pin opening 43 and within which the hinge pin is rotatably held; and when the hinge construction 10 is selectively located at the left-hand side of the door 50, not shown, the hinge pin 24 will extend through the left-hand hinge pin opening 42 and the opening at the bottom 52 of the door 50 that is in line with the left-hand hinge pin opening 42 and within which the hinge pin is rotatably held.

To facilitate the opening of the door 50 at the hinge construction 10 and the door-mounted hinge bracket 40, a bearing system is provided as can be seen in FIGS. 1 and 2. Specifically, a hinge pin supporting plate bearing, indicated generally at 34, is secured to the hinge pin supporting plate 14 by means of suitable fasteners provided at a supporting plate bearing opening 36 and a supporting plate first opening 17 that is adjacent the right-hand tapered opening 16. The hinge pin supporting plate bearing 34 includes a hinge pin supporting plate bearing opening 35 that is aligned with the right-hand tapered opening 16 and through which the hinge pin 24 extends when the hinge pin supporting plate bearing 34 is secured to the hinge pin supporting plate 14 at the supporting plate first opening 17. At the same time, a door-mounted hinge bracket bearing, indicated generally at 44, as best seen in FIGS. 1 and 3 is secured to the door-mounted hinge bracket 40 by means of a suitable fastener 41. The door-mounted hinge bracket bearing 44 includes an opening that, when the door-mounted hinge bracket bearing is secured to the door-mounted hinge bracket 40 at the right hand of the bottom 52 of the door 50, is aligned with the right-hand hinge pin opening 43, and the hinge pin 24 extends through both those openings and into the opening at the right-hand side of the bottom 52 of the door that is aligned with those openings when the door 50 is mounted at the hinge construction 10.

Should the hinge construction 10 and the door-mounted hinge bracket 40 be selectively located at the left-hand side of the door 50, as has been discussed above, the hinge pin supporting plate bearing 34 is secured to the hinge pin supporting plate 14 by means of suitable fasteners provided at the supporting plate bearing opening 36 and a supporting plate second opening 21 that is adjacent the left-hand tapered opening 15. In that case, the hinge pin supporting plate bearing opening 35 is aligned with the left-hand tapered opening 15 through which the hinge pin 24 extends when the hinge pin supporting plate bearing 34 is secured to the hinge pin supporting plate 14 at the supporting plate second opening 21. At the same time, the door-mounted hinge bracket bearing 44 is secured to the door-mounted hinge bracket 40 by means of suitable fasteners 41 at the left-hand side of the bottom 52 of the door 50. The left-hand hinge pin opening 42, when the door-mounted hinge bracket 40 is secured to the left hand of the bottom 52 of the door 50, is aligned with the opening for the hinge pin in the hinge pin supporting plate bearing 34, and the hinge pin 24 extends through both those openings and into an opening at the left-hand side of the bottom of the door that is aligned with those openings when the door 50 is mounted at the hinge construction 10.

Figure 4:
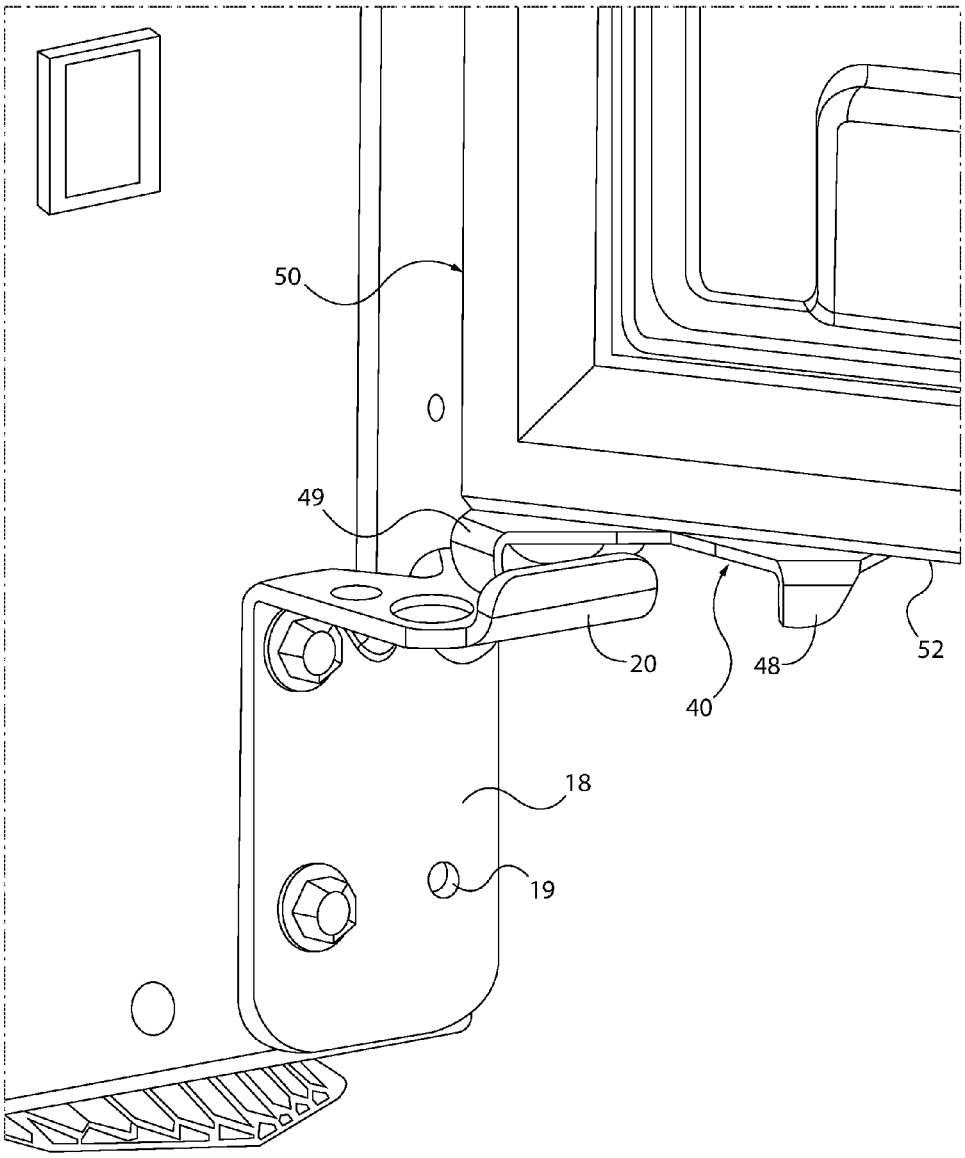
FIG. 4 is a perspective view of the hinge construction of FIG. 1 that illustrates the arrangement of the hinge construction when the door of the refrigeration appliance is opened to a maximum extent.

The door-mounted hinge bracket 40 can include at least one door stop, and in the example shown in the drawings two door stops comprising left-hand door stop 48 and right-hand door stop 49 are provided. These door stops limit the maximum extent to which the door 50 can be opened by engaging the back side of the supporting plate upturned portion 20 of the hinge pin supporting plate 14. Thus, when the hinge construction is located at the right hand side of the door 50, after the door 50 is initially opened and continues to be opened further, the right-hand door stop 49 will move in an arc of a circle until the right-hand door stop comes into contact with the back side of the supporting plate upturned portion 20. The relative positioning of the hinge construction 10 and the door-mounted hinge bracket 40 when the door 50 is opened to the maximum extent allowed as a result of the engagement of the right-hand door stop 49 with the back side of the supporting plate upturned portion 20 of the hinge pin supporting plate 14 is illustrated in FIG. 4. The positioning of the door stop and the supporting plate upturned portion 20 in relation to one another can be selected to allow the door 50 to be opened to whatever maximum extent is desired. When the hinge construction 10 and the door-mounted hinge bracket 40 are located at the left-hand side of the door 50, the left-hand door stop 48 will act to engage the back side of the supporting plate upturned portion 20, thereby stopping any further opening of the door.

As will be understood from the foregoing description, the hinge construction of the present invention provides a system that allows elements such as electrical wiring for example to be routed through the hinge construction. For example, in a refrigeration appliance, electrical wiring connected to a source of electrical power internally at the base of the refrigeration appliance can be routed from the base through the hinge pin bore 30 and into the door of the refrigeration appliance so as to provide electrical power to equipment at the door that requires such power. The electrical wiring can be threaded through the hinge pin bore 30 while the hinge pin 24 is in place at the hinge pin supporting plate 14; alternatively, the wiring can be threaded through the appropriate tapered opening, either left-hand tapered opening 15 or right-hand tapered opening 16, with the hinge pin 24 removed from that tapered opening, and the wiring can then be inserted into the hinge pin bore 30 through the hinge pin slot 32 after which the hinge pin 24 can be placed into the tapered opening.

The invention has been described herein above using specific examples; however, it will be understood by those skilled in the art that various alternatives may be used and equivalents may be substituted for elements or steps described herein without deviating from the scope of the invention. Modifications may be necessary to adapt the invention to a particular situation or to a particular need without departing from the scope of the invention. It is intended that the invention not be limited to the particular implementation described herein, but that the claims be given their broadest interpretation to cover all embodiments, literal or equivalent, covered thereby.

What is claimed is:

1. A hinge construction including:

a frame hinge bracket configured to be secured to a frame including a hinge pin supporting plate and a first and second frame bracket opening extending through the hinge pin supporting plate;

a hinge pin held within the first or second frame bracket opening, the hinge pin including:

a hinge pin outer surface; and a hinge pin bore extending through the entire length of the hinge pin;

a door hinge bracket that is configured to be secured to a door, comprising a first and a second door bracket opening; and a bearing system, comprising a first bearing having a first cam surface and a second bearing having a second cam surface that cooperates with the first cam surface during rotation of the door;

wherein the frame hinge bracket comprises an upturned portion, wherein the door hinge bracket comprises at least two protrusions, wherein the protrusions are configured to cooperate with the upturned portion to prohibit rotation of the door about a rotational axis defined by the hinge pin beyond respective certain positions in different rotational directions, wherein in a first configuration the hinge pin is held within the first frame bracket opening and the hinge pin extends through the first door bracket opening, wherein in a second configuration the hinge pin is held within the second frame bracket opening and the hinge pin extends through the second door bracket opening.

2. The hinge construction of claim 1, wherein the frame hinge bracket further includes a third and a fourth frame bracket opening, extending through the hinge pin supporting plate.

3. The hinge construction of claim 2, wherein in the first configuration a portion of the first bearing is operably held at the third frame bracket opening and in the second configuration a portion of the first bearing is operably held at the fourth frame bracket opening.

4. The hinge construction of claim 1, wherein in the first configuration the first protrusion is configured to cooperate with the upturned portion to prohibit rotation of the door beyond a first position in a first rotational direction about the rotational axis and in the second configuration the second protrusion is configured to cooperate with the upturned portion to prohibit rotation of the door beyond a second position in a second rotational direction about the rotational axis.

5. A hinge construction including:

a frame hinge bracket configured to be secured to a frame including a hinge pin supporting plate and a first and second frame bracket tapered opening extending through the hinge pin supporting plate;

a hinge pin including:

a hinge pin outer surface, including a hinge pin outer surface first portion that is tapered along a length of the hinge pin so as to be congruent with the first and second frame bracket tapered openings extending through the hinge pin supporting plate, the hinge pin being held within the first or second tapered opening at the hinge pin outer surface first portion; and a hinge pin bore extending through the entire length of the hinge pin;

a door hinge bracket that is configured to be secured to a door, comprising a first and a second door bracket opening; and a bearing system, comprising a first bearing having a first cam surface and a second bearing having a second cam surface that cooperates with the first cam surface during rotation of the door;

wherein the frame hinge bracket comprises an upturned portion, wherein the door hinge bracket comprises at least two protrusions, wherein the protrusions are configured to cooperate with the upturned portion to prohibit rotation of the door about a rotational axis defined by the hinge pin beyond respective certain positions in different rotational directions, wherein in a first configuration the hinge pin is held within the first frame bracket tapered opening and the hinge pin extends through the first door bracket opening, wherein in a second configuration the hinge pin is held within the second frame bracket tapered opening and the hinge pin extends through the second door bracket opening.

6. The hinge construction of claim 5 wherein the first portion of the hinge pin is selectively held within one of the first and second frame bracket tapered openings.

7. The hinge construction of claim 6 wherein each of the first and second frame bracket tapered openings are entirely circumscribed by the hinge pin supporting plate.

8. The hinge construction of claim 7 wherein the outer surface of the hinge pin includes a hinge pin outer surface second portion that has a cylindrical configuration and merges with the hinge pin outer surface first portion.

9. The hinge construction of claim 5 wherein each of the first and second frame bracket tapered openings are entirely circumscribed by the hinge pin supporting plate.

10. The hinge construction of claim 9 wherein the door is part of a refrigeration appliance.

11. The hinge construction of claim 9 wherein the outer surface of the hinge pin includes a hinge pin outer surface second portion that has a cylindrical configuration and merges with the hinge pin outer surface first portion.

12. The hinge construction of claim 11 wherein the second portion of the hinge pin is rotatably held at the door.

13. The hinge construction of claim 5 wherein the outer surface of the hinge pin includes a hinge pin outer portion second portion that has a cylindrical configuration and merges with the hinge pin outer surface first portion.

14. The hinge construction of claim 5, wherein the frame hinge bracket further includes a third and a fourth frame bracket opening, extending through the hinge pin supporting plate.

15. The hinge construction of claim 14, wherein in the first configuration a portion of the first bearing is operably held at the third frame bracket opening and in the second configuration a portion of the first bearing is operably held at the fourth frame bracket opening.

16. The hinge construction of claim 5, wherein in the first configuration the first protrusion is configured to cooperate with the upturned portion to prohibit rotation of the door beyond a first position in a first rotational direction about the rotational axis and in the second configuration the second protrusion is configured to cooperate with the upturned portion to prohibit rotation of the door beyond a second position in a second rotational direction about the rotational axis.

17. A hinge construction including:

a frame hinge bracket configured to be secured to a frame including a hinge pin supporting plate and a first, a second, a third, and a fourth frame bracket opening extending through the hinge pin supporting plate;

a hinge pin held within the first or second frame bracket opening, the hinge pin including:

a hinge pin outer surface; and a hinge pin bore extending through the entire length of the hinge pin;

a door hinge bracket that is configured to be secured to a door, comprising a first and a second door bracket opening; and a bearing system, comprising a first bearing having a first cam surface and a second bearing having a second cam surface that cooperates with the first cam surface during rotation of the door;

wherein the frame hinge bracket comprises an upturned portion, wherein the door hinge bracket comprises at least two protrusions, wherein the protrusions are configured to cooperate with the upturned portion to prohibit rotation of the door about a rotational axis defined by the hinge pin beyond respective certain positions in different rotational directions, wherein in a first configuration at least a portion of the first bearing is secured at the third frame bracket opening and the hinge pin is held within the first frame bracket opening and the hinge pin extends through the first door bracket opening, wherein in a second configuration at least a portion of the first bearing is secured at the fourth frame bracket opening and the hinge pin is held within the second frame bracket opening and the hinge pin extends through the second door bracket opening.

18. A hinge construction including:

a frame hinge bracket configured to be secured to a frame including a hinge pin supporting plate and a first and a second frame bracket opening extending through the hinge pin supporting plate;

a hinge pin held within the first or second frame bracket opening, the hinge pin including:

a hinge pin outer surface; and a hinge pin bore extending through the entire length of the hinge pin;

a door hinge bracket that is configured to be secured to a door, comprising a first and a second door bracket opening; and a bearing system, comprising a first bearing having a first cam surface and a second bearing having a second cam surface that cooperates with the first cam surface during rotation of the door;

wherein the frame hinge bracket comprises an upturned portion, wherein the door hinge bracket comprises at least two protrusions, wherein the protrusions are configured to cooperate with the upturned portion to prohibit rotation of the door about a rotational axis defined by the hinge pin beyond respective certain positions in different rotational directions, wherein in a first configuration the first protrusion is configured to cooperate with the upturned portion to prohibit rotation of the door beyond a first position, the hinge pin is held within the first frame bracket opening, and the hinge pin extends through the first door bracket opening, wherein in a second configuration the second protrusion is configured to cooperate with the upturned portion to prohibit rotation of the door beyond a second position, the hinge pin is held within the second frame bracket opening, and the hinge pin extends through the second door bracket opening.

* * * * *